US008474549B2

(12) United States Patent
Piipponen

(10) Patent No.: US 8,474,549 B2
(45) Date of Patent: Jul. 2, 2013

(54) METHOD AND DEVICES FOR HANDLING ROD-LIKE PIECES IN DRILLING AND BOLTING

(75) Inventor: Juha Piipponen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 304 days.

(21) Appl. No.: 12/809,353

(22) PCT Filed: Dec. 17, 2008

(86) PCT No.: PCT/FI2008/050749

§ 371 (c)(1),
(2), (4) Date: Aug. 12, 2010

(87) PCT Pub. No.: WO2009/080876

PCT Pub. Date: Jul. 2, 2009

(65) Prior Publication Data

US 2010/0307827 A1 Dec. 9, 2010

(30) Foreign Application Priority Data

Dec. 21, 2007 (FI) ..... 20075953

(51) Int. Cl.
*E21B 19/00* (2006.01)

(52) U.S. Cl.
USPC ..... 175/52

(58) Field of Classification Search
USPC 166/380, 77.51, 85.1; 175/52, 85; 414/22.51, 414/22.62, 746.3, 746.8; 405/259.1–259.6; 299/11
See application file for complete search history.

(56) References Cited

U.S. PATENT DOCUMENTS

| | | | |
|---|---|---|---|
| 3,986,618 | A | 10/1976 | Woolslayer et al. |
| 4,531,875 | A | 7/1985 | Krueger |
| 4,621,974 | A | 11/1986 | Krueger |
| 4,632,618 | A | 12/1986 | Issakainen |
| 5,687,804 | A | 11/1997 | Lappalainen et al. |
| 7,617,887 | B2 | 11/2009 | Piipponen |

FOREIGN PATENT DOCUMENTS

| | | |
|---|---|---|
| CN | 101076651 | 11/2007 |
| FI | 67125 | 1/1985 |
| FI | 67125 | 10/1985 |
| FI | 93256 | 3/1995 |

(Continued)

OTHER PUBLICATIONS

Notification of Reason for Refusal for Japanese Patent Application No. 2010-538809, dated Jul. 3, 2012, with English translation.

(Continued)

*Primary Examiner* — David Bagnell
*Assistant Examiner* — Taras P Bemko
(74) *Attorney, Agent, or Firm* — Morgan, Lewis & Bockius LLP

(57) ABSTRACT

A method and a rod magazine for handling elongated rods in a rock drilling unit, and a bolting unit. Elongated rods, such as drill rods and rock bolts, are stored into a linear rod magazine—provided with feed members for transferring the rods upward and downward in the magazine. The feed members comprise screw surfaces by which the rods are supported in the magazine. The required feeding movement is produced by rotating the feed members about their rotation axis. In addition, the rod magazine comprises transfer means that allow the rods to be transferred from the magazine to a drilling line or bolting line, i.e. to a center, and vice versa. The transfer means are provided with gripping means for gripping the rods.

29 Claims, 6 Drawing Sheets

FOREIGN PATENT DOCUMENTS

| | | |
|---|---|---|
| FI | 93256 | 10/1995 |
| GB | 794253 | 4/1958 |
| JP | 49-102003 | 12/1972 |
| JP | 52-72503 | 11/1975 |
| JP | 52-32801 | 3/1977 |
| JP | 54-96401 | 7/1979 |
| JP | 59-501675 | 10/1984 |
| JP | 11-101086 | 4/1999 |
| WO | 84/00789 | 3/1984 |
| WO | 2005/001236 | 1/2005 |

OTHER PUBLICATIONS

International Search Report on PCT/FI2008/050749, dated Apr. 23, 2009.

Notification of the First Office Action (with English translation), for Chinese Application No. 200880122014.3 , dated Sep. 29, 2012.

Finnish Search Report dated Nov. 4, 2008.

METHOD AND DEVICES FOR HANDLING ROD-LIKE PIECES IN DRILLING AND BOLTING

BACKGROUND OF THE INVENTION

The invention relates to a method for storing and handling elongated rods, such as drill rods and rock bolts, by means of a rod magazine arranged to an end of a boom. A plural number of rods are stored side by side into a linear rod magazine and moved in the magazine by means of one or more feed members. A feed member transfers the rods in the magazine towards or away from a feed station, depending on whether rods are being loaded into or unloaded from the magazine. The rods are then transferred to a drilling or bolting line, i.e. into a centre, with transfer means. During the transfer, a rod to be transferred is held with gripping members provided in the transfer means.

The invention also relates to a rod magazine, and to a rock drilling unit and a bolting unit provided with a rod magazine. The field of the invention is defined in greater detail in the preambles of the independent claims.

A rock drilling rig to be used for long-hole drilling may be provided with a rod magazine where drilling tools, such as drill pipes and extension rods, may be stored and handled by using a mechanism provided in connection with the rod magazine. The rod magazine is installed into a drilling unit in such a way that rods may be added between the rock drilling machine and a drill rod assembly already in a drill hole with the handling mechanism from the magazine and, correspondingly, rods may be removed from the assembly and returned into the rod magazine. The handling mechanism provided in connection with the rod magazine may comprise turning arms, or the like, provided with gripping means. With the turning arms a rod may be transferred from the rod magazine to the drilling centre and, correspondingly, returned from the drilling centre to the rod magazine. Prior art rod magazines include rotating magazines and linear magazines. A disadvantage observed in rotating magazines is their large width, which makes them difficult to arrange to a feed beam. U.S. Pat. No. 4,632,618 discloses a linear magazine, in which the rods are stored one on top of the other in a vertical line and the rods are fed in the magazine by means of feed'plates provided with grooves. The rod magazine of the US publication has a complex structure and its operational reliability has proved to be insufficient in demanding conditions.

SUMMARY OF THE INVENTION

It is an object of the invention to provide a novel and improved method and rod magazine for storing and handling drilling tools and rock bolts in a rock drilling rig, a further object being to implement a rock drilling unit and a bolting unit provided with an improved rod magazine.

The method of the invention is characterized by using a feed member provided with a screw surface for moving the rods in the rod magazine; preventing the displacement of the rods from contact with the screw surface; supporting the rods with the screw surface; and rotating the feed member about its rotation axis, the rods thus moving in the rod magazine towards a feed station located at an outermost end thereof or away from the feed station, depending on the direction of rotation, due to the influence of the screw surface.

The rod magazine of the invention is characterized in that the feed member comprises a screw surface that supports the rods in the rod magazine; the rods are supported by at least one transverse support on the side facing away from the feed member, which prevents the displacement of the rods from contact with the screw surface; and the feed member is rotatable about its rotation axis, whereby the rods move in the rod magazine towards the feed station or away from it, depending on the direction of rotation, due to the influence of the screw surface.

The rock drilling unit of the invention is characterized in that the feed member of the rod magazine comprises a screw surface by which the drill rods are arranged to be transferred; and the feed member is rotatable about its rotation axis, whereby the rods are arranged to move in the rod magazine towards the feed station or away from it, depending on the direction of rotation, due to the influence of the screw surface.

The bolting unit of the invention is characterized in that the feed member of the rod magazine comprises a screw surface by which the rock bolts are arranged to be transferred; and the feed member is rotatable about its rotation axis, whereby the rock bolts are arranged to move in the rod magazine towards the feed station or away from it, depending on the direction of rotation, due to the influence of the screw surface.

The invention is based on the idea that the rod magazine is of a linear type, the rods being stored in one line, in which they are parallel, side by side. The rod magazine comprises at least one feed member, which in turn comprises a screw surface, by which the rods are arranged to be moved in the magazine. The rods are moved in the magazine towards the feed station or away from it by rotating the feed member about its axis of rotation. The rods may be supported in such a way that the rods remain in contact with the screw surface.

An advantage of the invention is that a feed member provided with a screw surface is an operationally reliable and simple component. In addition, the operation of the feed member is easy to control and automate. Further, due to the new construction the rod magazine may be light and occupy a little space. Moreover, it is easy to protect against damage.

According to an embodiment, the feed member comprises an elongated body having a spiral provided with a pitch arranged around it. This kind of feed member is light. An additional advantage of the spiral structure is that it is fairly easy to modify the feed member by providing it with screw surfaces of different pitches.

According to an embodiment, the feed member comprises a spiral with a pitch, the spiral in itself being solid enough so that it does not need to be supported by a separate body portion from inside the spiral. This kind of feed member is particularly light and simple. Maintaining the rods in contact with the screw surface of the spiral may be ascertained by supporting the rods both at the side of the feed member and at a side opposite thereto by one or more transverse supports. The transverse support may in fact be a clevis-type piece.

According to an embodiment the feed member is an elongated screw, whose outer surface comprises threading with a pitch. The screw member is a solid, resistant and simple component.

According to an embodiment the pitch of the feed member is dimensioned to be in line with the diameter of the largest rod to be handled. Hence the diameter of the feed member is suitable for different rods.

According to an embodiment the feed member is tilted in relation to the diameter of the rods to be handled. The tilting takes place on a plane parallel to the longitudinal axes of the rods. The tilting allows the rod magazine to be adjusted for rods of different diameters, which means that the rod magazine may be utilized for different rods without significant changes. The tilting reduces gaps between the feed member and the rods to be handled, which allows swinging of the rods and the resulting vibration and noise to be reduced.

According to an embodiment the feed member may be tilted in relation to the rods in the magazine in such a way that the angle of tilt corresponds to the pitch of the screw surface. In that case there are linear contact surfaces between the lower surface of the rods and the screw surface. A linear contact surface has a smaller surface pressure than a spot-like contact surface. The tilting takes place on a plane parallel to the longitudinal axes of the rods.

According to an embodiment the rod magazine comprises at least two feed members at a distance from one another and at least two transfer members or the like at a distance from one another. An advantage of this embodiment is that the handling of the rods is accurate and precise.

According to an embodiment the feed members at a distance from one another are tilted in directions away from one another. This allows axial forces acting on the rods to be cancelled.

According to an embodiment the rod magazine comprises a first end support and a second end support, which are arranged at the ends of the rods in the magazine. The end supports prevent longitudinal movement of the rods.

According to an embodiment the transfer means include at least one arm, which is turnable by a turning device along a curvilinear path between a feed station at the upper part of the feed member and a centre. The outermost end of the arm is provided with gripping means for gripping the rods.

According to an embodiment the transfer means include at least one arm, which is movable by one or more simultaneous or non-simultaneous linear movements between the feed station at the upper part of the feed member and the centre. The outermost end of the arm is provided with gripping means for gripping the rods.

According to an embodiment the feed station of the rod magazine is movable from an initial position to the centre, when the rod is moved to the centre or away from it. The initial position is the basic position of the rod magazine when moved out of the way of the drilling equipment or bolting equipment.

According to an embodiment the rod magazine is turnably arranged with regard to a joint, whereby its feed station is turnable between the initial position and the centre. Alternatively, the rod magazine is arranged to be turned by a joint mechanism. The turnable rod magazine may be particularly small especially in a lateral direction. Moreover, it may be simple and light.

According to an embodiment the rod magazine is arranged to be movable along one or more guide surfaces. Alternatively, the rod magazine is arranged to move by one or more linear movements. An aspect common to these applications is that the feed station is transferred from the initial position to the centre and vice versa.

According to an embodiment the rod magazine is arranged in connection with a feed beam at the outermost end of the boom.

According to an embodiment the rod magazine has one or more counter pieces against which the feed member is arranged to push the outermost rod in the magazine, when it is transferred to the feed station of the rod magazine. The counter piece may be provided with a surface restricting the movement of the outermost rod in the feed direction of the feed member. Further, the counter piece may be provided with a space for receiving a rod and means for holding the rod. The counter piece allows a rod to be fed to be precisely positioned in the feed position, which facilitates the handling of the rod.

According to an embodiment the feed member is arranged to hold the rod at the feed station by means of at least one counter piece, when the feed station is transferred to the centre. In that case, no separate gripping means or actuators for them are needed.

According to an embodiment the rod to be handled is a drilling tool. The drilling tool may be a drilling pipe, an extension rod or a similar elongated member used in drilling.

According to an embodiment the extension rod to be handled is a rock bolt, which is an elongated piece that may be arranged into a drill hole drilled into rock and anchored in place so as to allow it to support the ceiling or a wall of the space excavated in the rock. Rock bolts are mounted in place using a bolting apparatus.

LIST OF THE FIGURES

Some embodiments of the invention will be discussed in greater detail with reference to the accompanying drawings, in which FIG. 1 is a schematic side view of a rock drilling rig;

Figure 11:
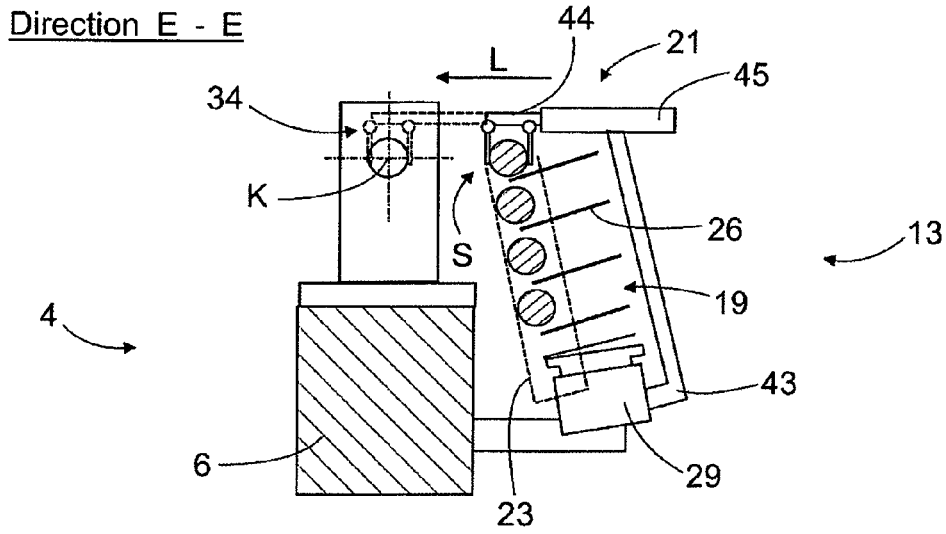
Figures 12, 13:
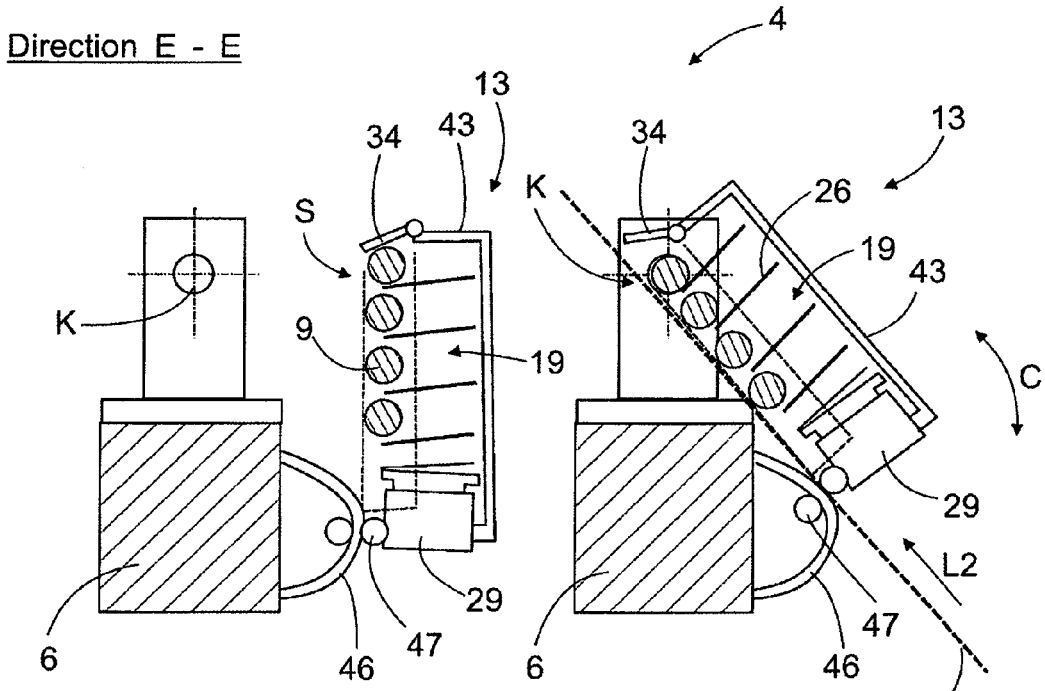

FIG. 11 is a schematic view of a rod magazine seen in a longitudinal direction of the feed beam, the magazine being provided with a spiral feed member and a transfer member moving in a linear direction; and FIGS. 12 and 13 are schematic views of a rod magazine seen in a longitudinal direction of a feed beam, the magazine being arranged to move guided by a guide surface between an initial position and a centre.

For the sake of clarity some embodiments of the invention have been simplified. Like parts are indicated in the figures with like reference numerals.

DETAILED DISCLOSURE OF THE INVENTION

Figure 1:
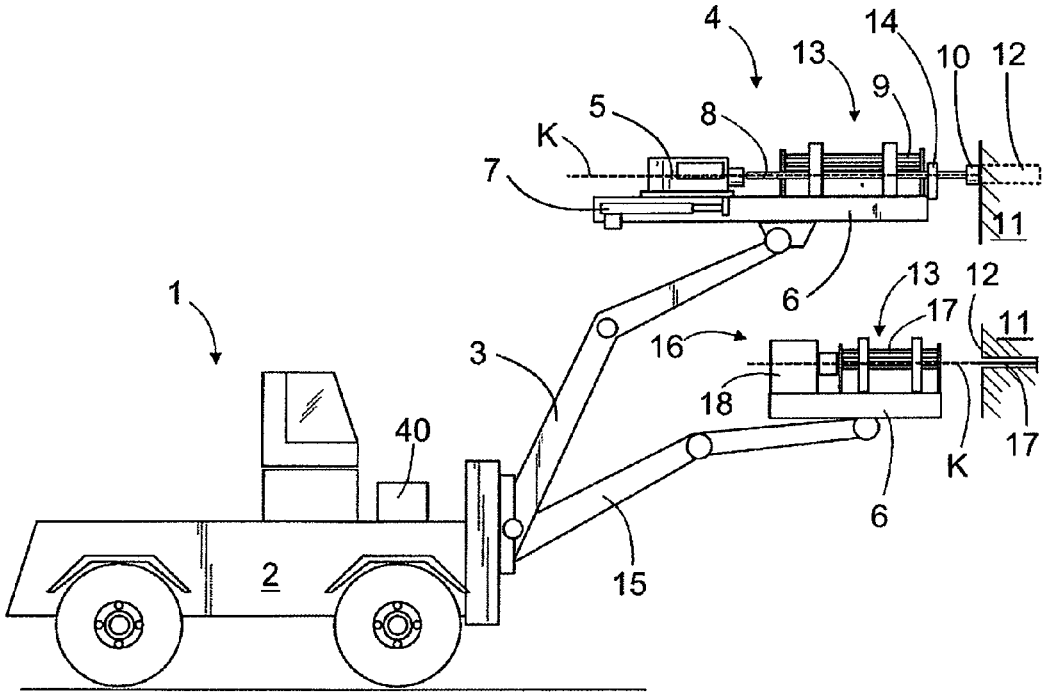

FIG. 1 shows a rock drilling rig 1 comprising a movable carrier 2 with one or more booms 3 arranged thereto, the booms being provided with a rock drilling unit 4. The rock drilling unit 4 comprises a rock drilling machine 5 that may be moved along a feed beam 6 by means of a feeding device 7. The rock drilling machine 5 may have a tool 8 connected thereto, which tool may comprise a plural number of successive drill rods 9 connected to one another by connecting members, such as a screw joint. Further, an outermost end of an outermost drill rod 9 is provided with a drill bit 10 having drill buttons for producing a drill hole 12 into rock 11. The rock drilling machine 5 may comprise a percussion device for supplying impact pulses to the tool 8, which transfers them to the drill bit 10 and further to the rock 11 to be broken. The rock drilling machine 5 may also comprise a rotating device that allows the tool 8 to be rotated about its longitudinal axis during drilling.

The drilling unit 4 is further provided with a rod magazine 13 supported to the feed beam 6. The rod magazine 13 may be used for storing drill rods 9 and other drilling tools needed in long-hole drilling. The rod magazine 13 is provided with handling tools for transferring the drilling tools between the rod magazine 13 and the drilling axis, i.e. a centre K.

In addition to the rock drilling machine 5, the drilling unit 4 may be provided with a bolting device, arranged to the feed beam 6 in an indexed manner, for example, to allow rock bolts to be stored in the rod magazine 13. For the sake of clarity, the figure does not show a bolting device in connection with the drilling unit 4.

Further, the rock drilling rig 1 may be provided with one or more booms 15 provided with a bolting unit 16 to be used for mounting a rock bolt 17 into a drill hole 12 drilled in advance. The bolting unit 16 comprises a bolting device 18, which may be arranged to the feed beam 16 or the like. The bolting device 18 may be provided with the rod magazine 13 of the invention for storing the rock bolts 17 and for taking them to the bolting line, i.e. to the centre K, of the bolting device 18.

Figure 2:
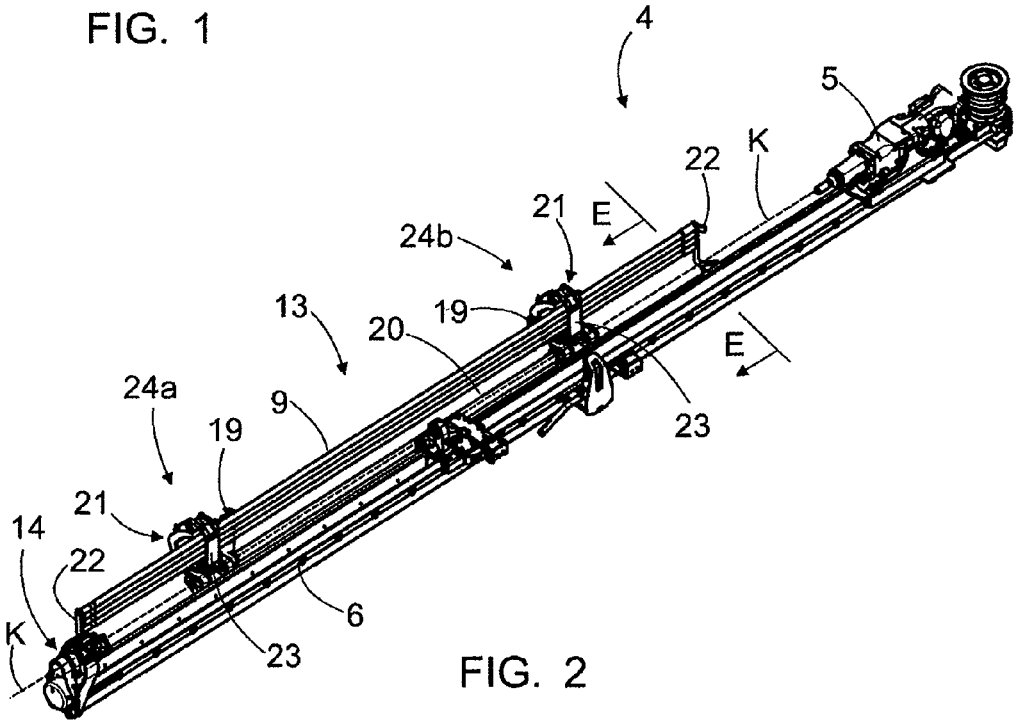
FIG. 2 is a schematic perspective view of a drilling unit provided with a rod magazine of the invention.

FIG. 2 shows a drilling unit 4 comprising a rod magazine 13 for storing and handling drill rods 9. The storage principle of the rod magazine 13 is linear, i.e. the rods 9 are arranged in one line, parallel to each other, side by side. FIG. 2 shows an implementation in which the rods are vertically, one on top of the other. The rod magazine 13 comprises two feed members 19 that support the rods 9. The feed members 19 are arranged at a distance from one another and at a distance from the ends of the rods 9, whereby also long rods 9 are well-supported. The feed members 19 are elongated pieces that may be rotated about their longitudinal axis. The feed members 19 may be provided with a rotation motor, such as a hydraulic motor. The feed members 19 comprise screw surfaces that allow the rods 9 to be transferred within the rod magazine 13. Further, the rod magazine 13 may comprise two transfer members 21 that may be arranged in connection with the feed members 19. With the transfer members 21 the rods 9 may be transferred from the rod magazine 13 to the centre K and vice versa. Detailed construction and function of the feed member 19 and those of the transfer member 21 are shown in subsequent figures.

FIG. 2 further shows that the rod magazine 13 comprises end supports 22, which prevent the rods 9 from sliding in their longitudinal direction, when the drilling unit 4 is directed upward or downward. The end support 22 may be an arm supported to the feed beam 6, the outermost portion of the arm being provided with a support surface on the side of the rod ends. The rod magazine 13 may further comprise two transverse supports 23, which may be arranged at the feed member 19, on the side facing away from it. The transverse supports 23 prevent the rods 9 in the rod magazine 13 from moving away from contact with the screw surface of the feed member 19 in the transverse direction. The transverse support 23 may be supported to the feed beam 6 and it may comprise a planar support surface against which the rods 9 are easy to transfer with the feed member 19. The rod magazine 13 thus comprises at least two handling units 24*a*, 24*b* at a distance from one another, the units comprising, in turn, at least the feed member 19, the transfer member 21 and the transverse support 23. These handling units 24*a*, 24*b* may be easily provided with shields around them to prevent damage. On the whole, the rod magazine 13 of the invention may have a fairly light and simple structure. In some cases the rod magazine may comprise only one handling unit.

Figure 3:
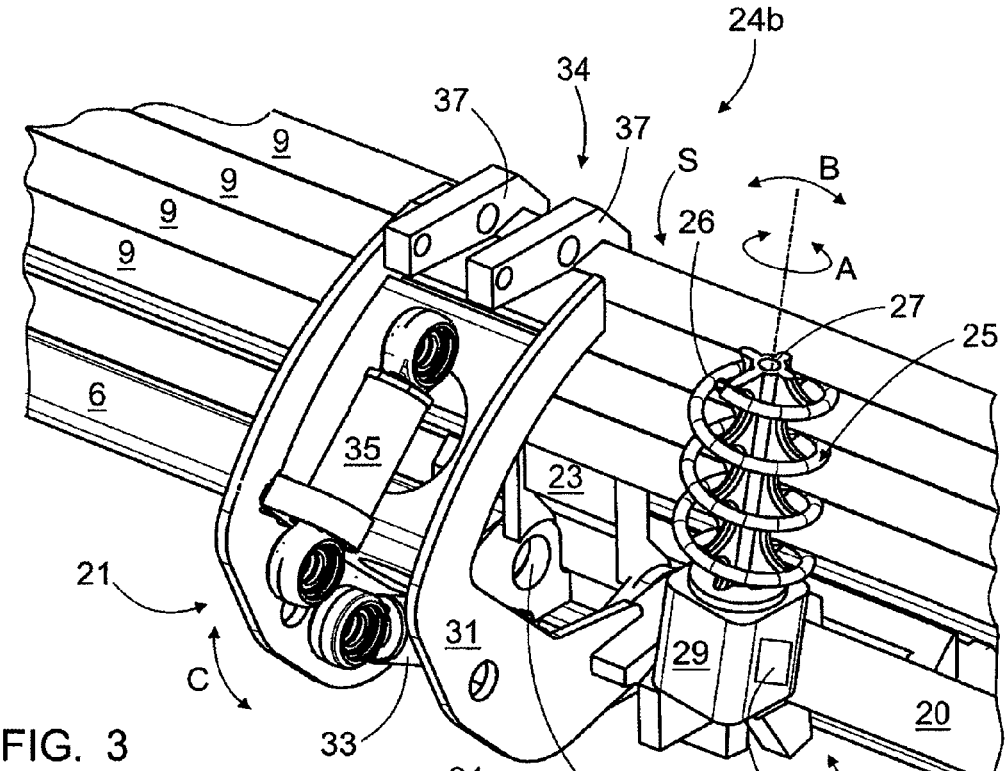
FIG. 3 is a schematic perspective view of a handling unit for a rod magazine of the invention.
Figure 4:
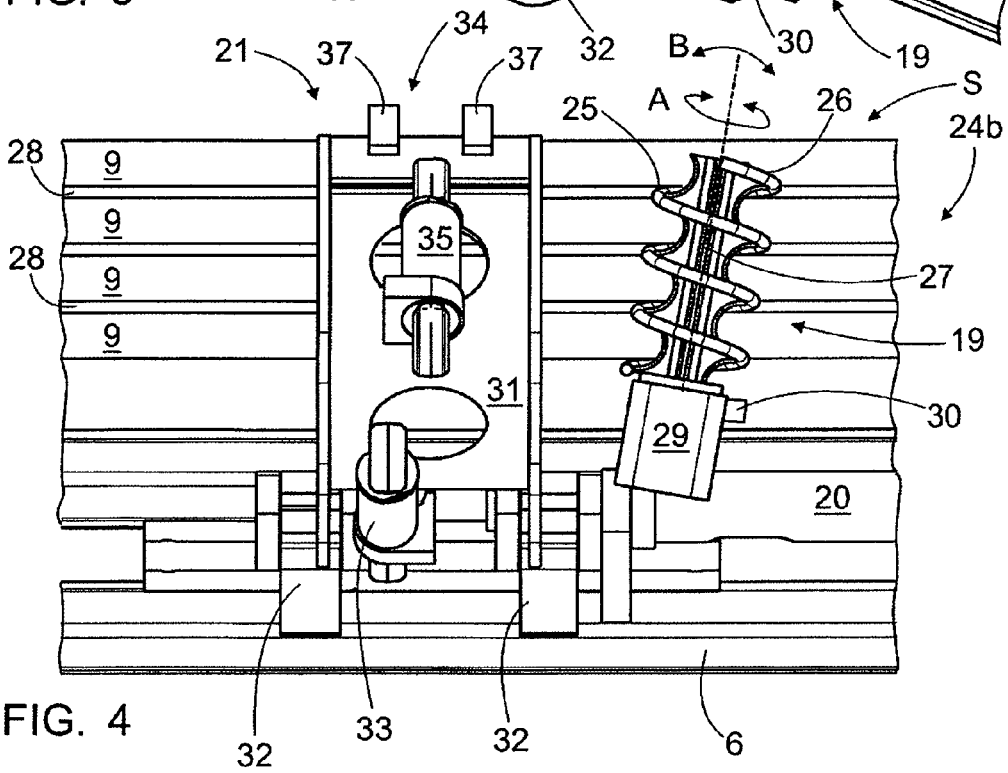
FIG. 4 is a schematic side view of a handling unit of FIG. 3.

FIG. 3 shows a handling unit 24*b* belonging to the rod magazine 13. A vertical rod magazine 13 holds four rods 9 stored linearly, one on top of the other. Naturally the rod magazine 13 may be dimensioned for a smaller or greater number of rods. The rods 9 are transferred in a linear direction by a feed member 19 comprising a screw surface 25. In the application of FIG. 3, the screw surface 25 is a spiral 26, which is supported to an elongated body 27 of the feed member 19, the body being rotatable about its longitudinal axis in such a way that the screw surface 25 against the lower surfaces of the rods 9 raises or lowers the rods, depending on rotation direction A of the feed member 19. No separate intermediate pieces are needed between superimposed rods 9 to produce gaps 28 between the rods 9, because the spiral 26 is between the rods 9 and inevitably forms a gap 28 between them, as shown in FIG. 4. The body 27 of the feed member 19 may be rotated by a rotation motor 29. Instead of the spiral 26, the feed member 19 may comprise an elongated screw that is rotated about its longitudinal axis. This application does not require a separate body 27. The pitches of the screw and the spiral 26 are dimensioned so that the rods to be handled fit into the space between the threads or the spirals. In addition, the screw surface 25 and the rests of feed member construction are to be dimensioned so as to allow the mass of the rods 9 to be received in the rod magazine 13. This aspect must be taken into account also in the dimensioning of the rotating means.

FIGS. 3 and 4 show that the feed member 19 may be tilted by a predetermined angle B in relation to the rods 9. The tilting takes place in a plane parallel to the longitudinal direction of the rods 9. The upper ends of the feed members 19 of the handling units 24*a* and 24*b* may be tilted towards each other. The degree of the tilting angle B may be selected according to the pitch of the screw surface 25 in such a way that the lower surfaces of the rods 9 rest against a linear counter surface of the spiral 26 or a planar counter surface of the screw thread. The feed member 19 may be arranged at a fixed tilt angle B or, alternatively, the tilt angle B may be adjusted manually or using a suitable actuator. The pitch of the spiral 26 of the feed member 19 or, alternatively, the pitch of the screw thread may be dimensioned according to the rod 9 having the largest cross-section. However, a rod magazine 13 provided with this kind of feed member 19 may be used also for handling rods 9 of a smaller diameter. If in this case the formation of gaps between the rods 9 of a smaller diameter and the feed member 19 and the swinging of the rods 9 caused thereby are to be prevented, the feed member 19 may be tilted in direction B, which allows the gaps to be reduced. It is also possible that a piece having the screw surface 25 of the feed member 19 is an interchangeable piece that is easy to change according to the rods 9 to be handled at a particular time.

FIGS. 3 and 4 show that the feed member 19 may be provided with a sensor 30 that may be used for monitoring the rotation of the feed member 19. A measurement result obtained from the sensor 30 may be transmitted to a control unit 40 controlling the operation of the rod magazine 13. The pitch of the feed member 19 may be dimensioned for example such that one full turn about the longitudinal axis causes the rod 9 to move upward or downward for one position in the rod magazine 13. Naturally there are also other means of arranging the dimensioning and the control strategy, because the control unit 40 may calculate the rotation need of the feed member 19 on the basis of the pitch of the screw surface 25 and the required transfer distance.

Further, FIGS. 3 and 4 show a transfer member 21 comprising an arm 31 having substantially the shape of a letter C and coupled to the feed beam 6 by a joint 32. The transfer member 21 may be turned with a turning member 33 in direction C, transverse to the feed beam 6. The outermost part of the transfer member 21 may be provided with gripping means 34, such as jaws 37, for gripping the rods 9. The gripping means 34 may be used in direction D with a gripping actuator 35. The turning device 33 and the gripping actuator 35 may be hydraulic cylinders, presented only schematically in FIGS. 3 and 4. Alternatively, other actuators suitable for the purpose may be used.

Figure 5:
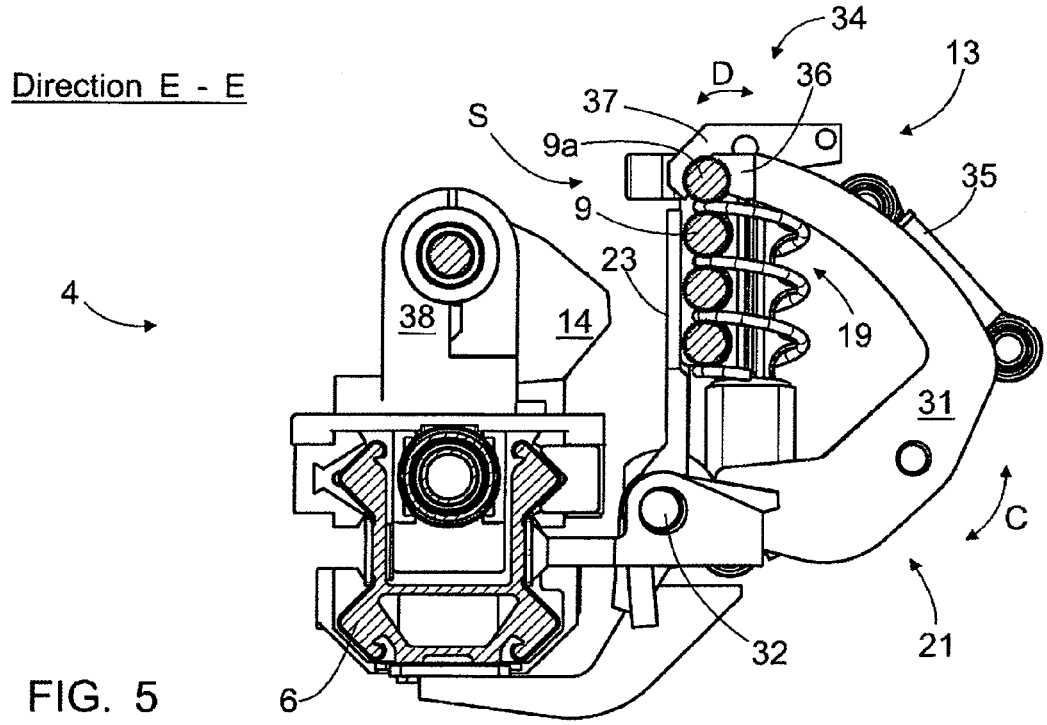
FIG. 5 is a schematic view of a drilling unit provided with a rod magazine, seen in the longitudinal direction of a feed beam.
Figure 6:
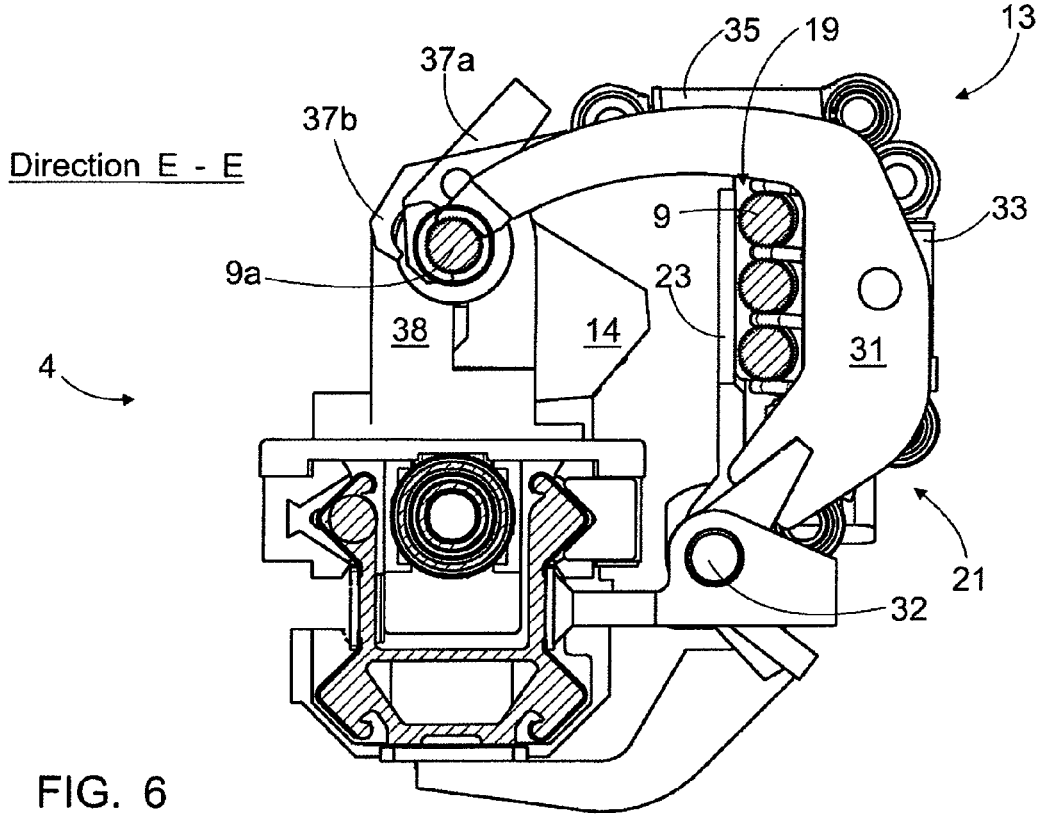
FIG. 6 is a schematic view of the drilling unit of FIG. 5 in a situation in which an arm mechanism belonging to the rod magazine has transferred a rod from the rod magazine to a drilling line.

In FIG. 5 the transfer member 21 has been turned into its initial position, the outermost end of the arm 31 being at the feed member 19. The outermost end of the arm 31 may be provided with a counter piece 36, and the feed member 19 may transfer the outermost rod 9*a* of the rod magazine 13 towards it so as to be supported by it. In its simplest form the counter piece 36 may be a piece shaped to correspond to the outer surface of the rod, as shown in the figure. The counter piece 36 may also comprise a space or a feed station 39 provided with a latch, for example, or a similar retaining mechanism and into which the outermost rod 9*a* fed from the rod magazine 13 may penetrate. It is also possible that the upper part of the feed member 19 is provided with means for receiving the outermost rod 9*a* and for retaining it until the transfer member 21 takes the rod for handling. Further, the gripping means 34 at the outermost end of the arm 31 may comprise one or more openable or closable jaws 37, which are used by the gripping actuator 35. The jaws 37 of the transfer member 21 may press the outermost rod 9*a* in the rod magazine 13 against the counter piece 36. Next, the arm 31 may be turned in direction C for transferring the rod 9*a* to the drilling line, i.e. the centre K. This situation is shown in FIG. 6. As seen therein, the C-shape of the arms enables them to turn in the transverse direction without the arms colliding with other rods 9 in the rod magazine 13. Since the arms 31 are located next to the feed member 19, the arms 31 do not collide with the feed member 19 when turning. When a rod 9*a* has been taken to the centre K, the jaws 37 may be opened and the arm 31 may be returned to its initial position shown in FIG. 5 to allow the next rod to be introduced. In this connection detailed handling of the rods in the centre, such as the opening and fastening of the connecting members, is not described.

Once a drill hole has been drilled and the extension rod equipment is dismantled, the arm 31 is taken to the centre K, whereby the counter piece 36 sets against the rod 9*a* in the centre, after which the jaws 37 are closed and the arm 31 is turned to its initial position at the feed member 19. Next, the jaws 37 are opened and the rod 9*a* is transferred to the supporting screw surface 25 of the feed member 19. The feed member 19 is rotated so that the rod 9*a* introduced into the rod magazine 13 moves there one position downward, whereby a place becomes vacant at the feed station S for the rod to be introduced next. This continues until all the rods have been unloaded or until the rod magazine 13 is full of rods.

Figure 7:
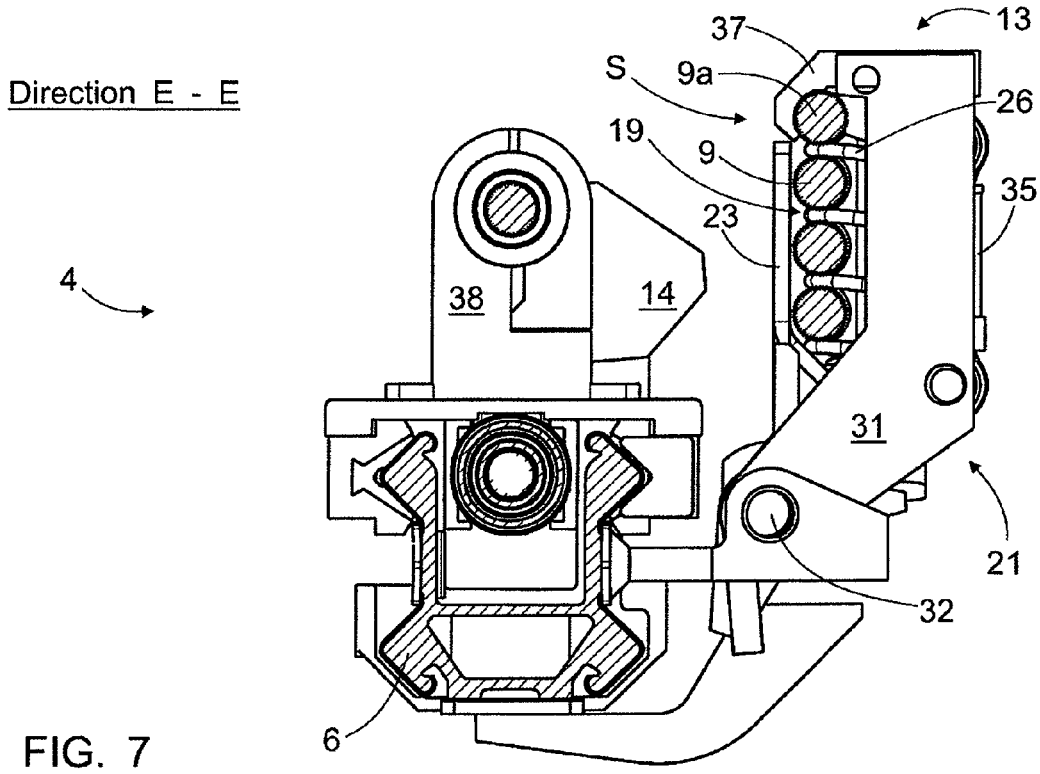
FIG. 7 is a schematic view in a longitudinal direction of a drilling unit provided with a turning rod magazine.
Figure 8:
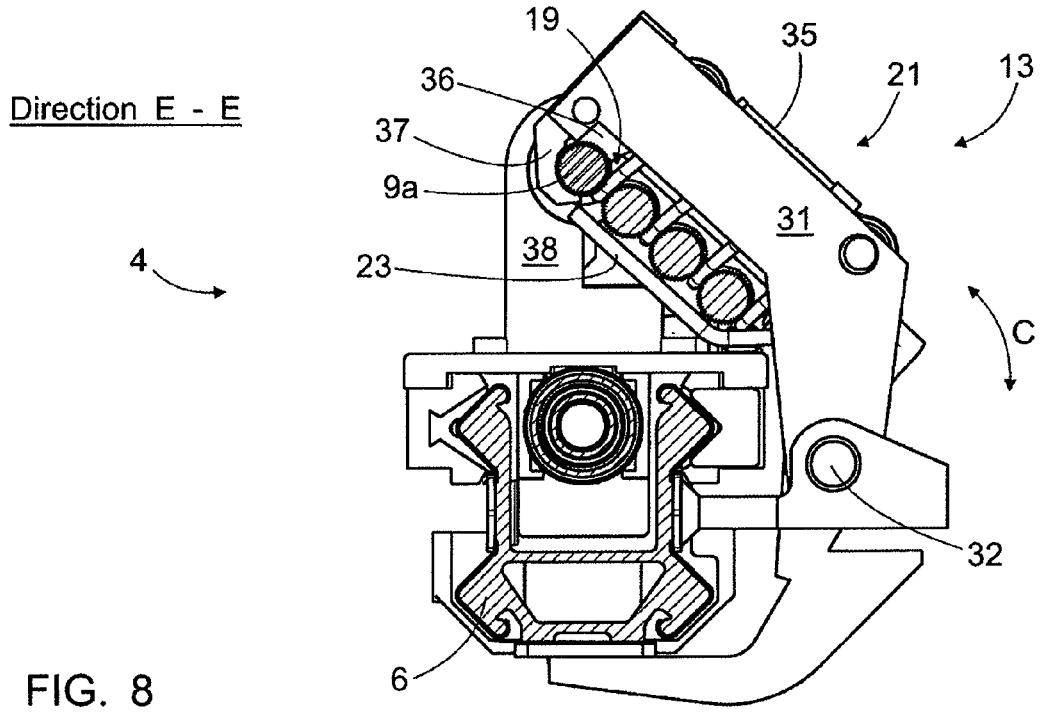
FIG. 8 is a schematic view of the drilling unit of FIG. 7 in a situation in which the rod magazine has been turned so as to take the rod to the drilling line.

FIGS. 7 and 8 show an application of the rod magazine 13, in which the feed member 19 and the transverse support 23 are arranged to turn in direction C together with the arm 31. In that case also all the rods 9 in the rod magazine 13 turn, and there is no need to shape the arm in the form of a letter C as in the previous figures, because it cannot collide with the rods any more. Hence the construction of the rod magazine 13 may be narrower than the one shown in FIGS. 5 and 6. The rod magazine 13 as a whole is arranged to turn in relation to a joint 32, thus allowing the feed station S at the upper part of the feed member 19 to be taken to the centre K as shown in FIG. 8. In other respects, the features of the embodiments shown in FIGS. 3 to 6, for example as regards the feed member 19, may be employed in the embodiment of FIGS. 7 and 8.

An embodiment of FIGS. 7 and 8 may be one in which the rod magazine 13 does not comprise any arms 31 at all, but the turning feed member 19 acts as the transfer member. In that case the feed station S at the upper part of the feed member 19 may be provided with the required gripping means.

Figure 9:
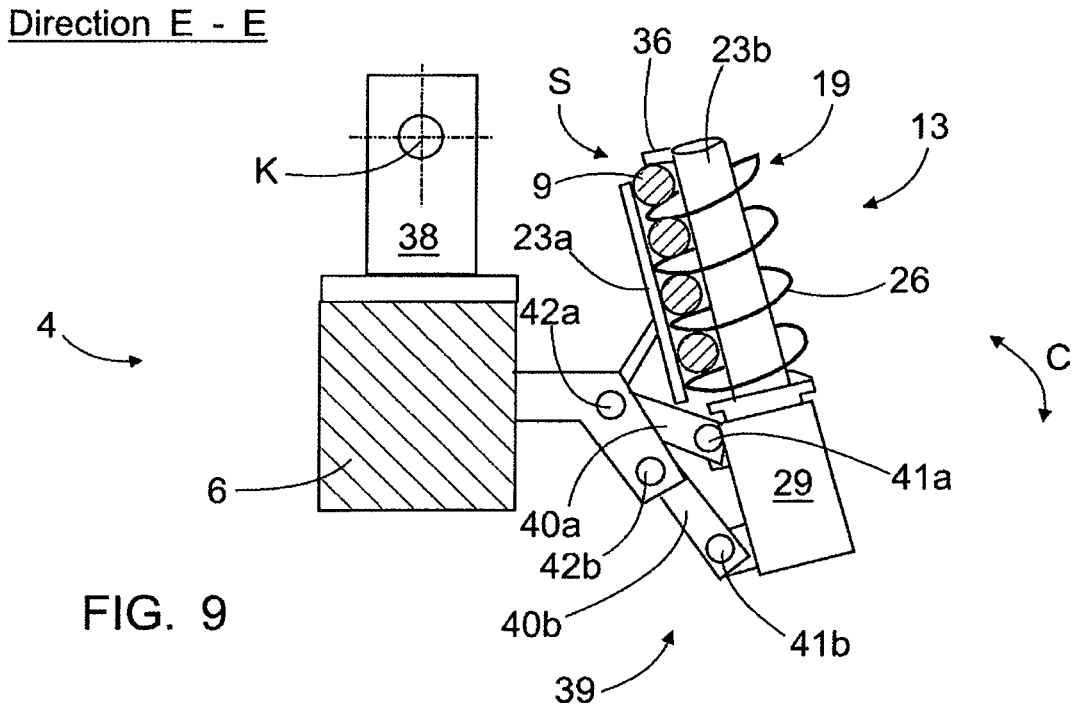
FIGS. 9 and 10 are schematic views of a rod magazine seen in a longitudinal direction of the feed beam, the magazine being arranged to turn by means of a joint mechanism.
Figure 10:
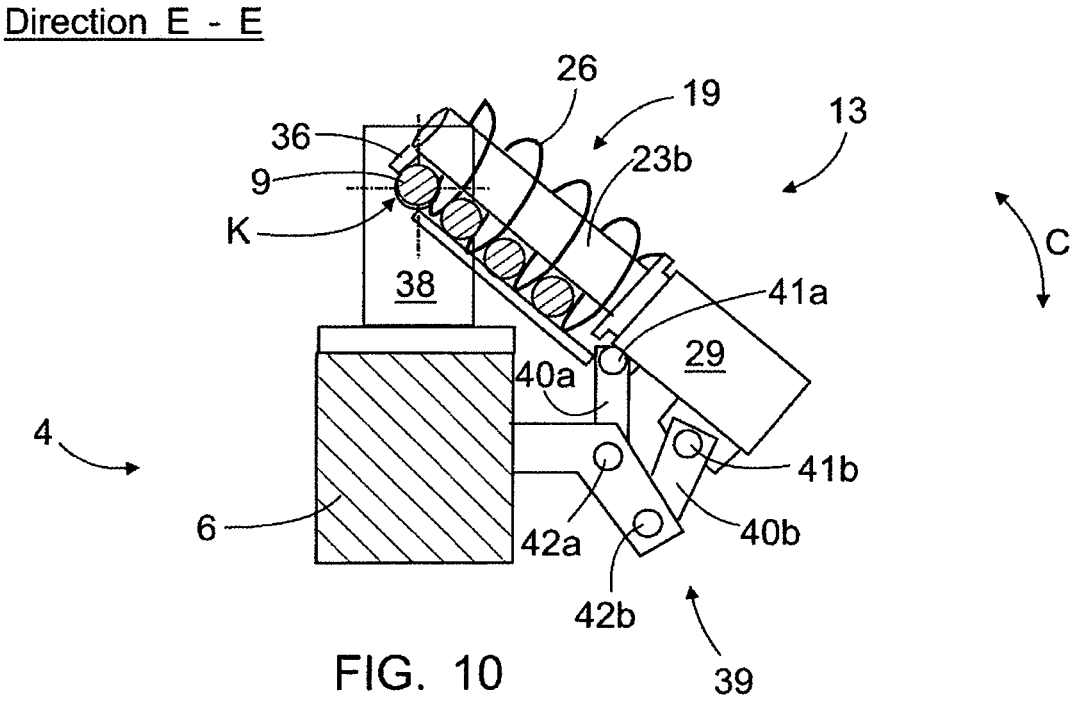

FIGS. 9 and 10 show a rod magazine 13 that may be moved by a joint mechanism 39. FIG. 9 shows the initial position and FIG. 10 a situation in which the feed station S has been taken to the centre K. The joint mechanism 39 may contain at least two arms 40*a* and 40*b*, which are turnably arranged by joints 41*a* and 41*b* to the feed mechanism 19, and, on the other hand, supported to the feed beam 6 by joints 42*a* and 42*b*. The joint mechanism 39 is arranged in such a way that the rod magazine 13 turns in direction C along a changing curvilinear path. The dimensions of the arms and the mutual position of the joints may be used to influence the shape of the curvilinear path. The curvature of the path changes so that its radius becomes smaller towards the centre K. An advantage of this is that the rod magazine 13 does not increase the dimensions of the drilling unit in the height direction. Naturally it is possible to use also other joint mechanisms suitable for the purpose for moving the rod magazine 13.

Further, the feed member 19 shown in FIGS. 9 and 10 is a spiral 26, which is dimensioned so that it is capable of carrying the mass of the rods 9 without being supported to any body in the middle of the spiral as shown in FIGS. 3 to 8. Inside the spiral 26 or, alternatively, on the outside thereof, there may be a non-rotatably arranged transverse support 23*b*, which together with the transverse support 23*a* maintains the rods 9 in a linear row and prevents the displacement of the rods 9 from contact with the spiral 26. The counter piece 36 and the gripping means, if any, may be arranged to the free end of the transverse support 23*b*. The transverse supports 23*a* and 23*b* may be replaced by a non-rotatably arranged tube arranged around the feed member 19 and having a groove opening to the feed station S, the groove being parallel to the rods 9 in the magazine to allow the rods to be moved in the magazine. Naturally transverse supports of some other structure are also possible.

It is also conceivable that the rod magazine 13 does not have any separate gripping means, but the feed member 19 and the counter piece 36 may be arranged to jointly function as kind of gripping members and maintain the rod in the feed station S, when the rod magazine 13 is transferred to the centre K. With the feed member 19 the rod 9 may be pushed against the counter piece 36 or a similar surface. Consequently, separate gripping members are not needed, whereby the structure may be even simpler.

FIG. 11 shows a rod magazine 13 in its initial position at a diagonal angle to the feed beam 6. The feed member 19 may be a spiral 26 supported only to the rotation motor 29. Outside the spiral 26 may be arranged a non-rotatable support 43, the upper part of which may be provided with a transfer member 21, which may comprise an arm 44 moving in linear direction L. The arm 44 may be moved by a suitable actuator 45, such as a hydraulic cylinder. The arm 44 is provided with gripping means 34 that may be moved in linear direction L between the feed station S and the centre K.

FIGS. 12 and 13 further illustrate a solution, in which the rod magazine 13 may be transferred guided by a guide surface 46 from an initial position according to FIG. 12 to a situation shown in FIG. 13 with the feed station S in the centre K. The rod magazine 13 may be supported to the guide surface 46 by rolls 47, for example. Naturally there are also other ways of construing the guide surface 46 and the support members supported thereto. FIG. 13 in fact depicts a guide surface shown with a broken line, the rod magazine 13 being movable along the surface in linear direction L2 for taking the feed station S to the centre K.

Typically the rod magazine 13 is arranged on one side of the feed beam, as shown in the Figure. Depending on the handedness of the drilling unit or the bolting device, the rod magazine may be on the right-hand or the left-hand side, when seen from the direction of the boom. Both sides of the feed beam 6 may be provided with mounting members, which allows the handedness of the drilling unit to be changed easily. The structure of the rod magazine 13 may be symmetric, in which case it may be attached to either side of the feed beam 6 without any changes. In some cases the rod magazine 13 may be arranged on both sides of the feed beam 6, whereby the number of drilling tools or rock bolts to be stored may be greater. In that case both rod magazines 13 may be provided with separate feed members 19 and transfer members 21. The application of the rod magazine 13 shown in FIGS. 7 and 8, for example, is simple to arrange on both sides of the feed beam. Further, the transfer member 21 of the rod magazine 13 of the type shown in FIGS. 5 and 6 may be construed, unlike in the figures, with one common transfer member arranged to transfer rods between the centre and both the feed members. It is also possible that on a first side of the feed beam there is a drill rod magazine and on a second side a rock bolt magazine.

Instead of a uniform spiral 26 or a screw, the screw surface of the feed member 19 may be formed so that it comprises a plural number of screw elements arranged with regard to one another so as to jointly form a screw with a pitch to allow rods to be supported and/or transferred. The screw elements may be pins, plates or similar protrusions, for example, which are arranged to the outer surface of a rotatable body to be rotated with a rotation motor in such a way that an imaginary screw line with a pitch may be drawn through the support surfaces meant to set against the rods of the screw elements.

Instead of a vertical position, the initial position of the rod magazine 13 may be a diagonal position, as in FIGS. 9 and 11, for example, or it may even be a horizontal position.

Although FIGS. 3 to 13 show features of the rod magazine 13 and different applications in relation to a drilling unit, corresponding features, characteristics and applications may be used also in connection with a bolting device for storing and handling rock bolts.

In this application vertical position means the basic position of a drilling unit or a bolting unit, the feed beam and the devices connected thereto being in a vertical position. When the boom and the feed beam are turned during drilling and bolting, a vertical linear magazine may be in a tilted or even in a nearly horizontal position. However, the magazine still maintains its relative orientation with regard to the feed beam, even if its absolute orientation changed.

In some cases the features disclosed in this application may be used as such, irrespective of the other features. On the other hand, the features disclosed in this application may also be used to provide different combinations, when necessary.

The drawings and the related specification are only intended to illustrate the inventive idea. The details of the invention may vary within the scope of the claims.

The invention claimed is:

1. A method for handling rods in a rock drilling rig, the method comprising the steps of:

storing elongated rods into a linear rod magazine, in which the rods are supported parallel to each other, side by side, and at a distance from one another, moving the rods with a feed member in the rod magazine, and moving a rod that is in the rod magazine by means of transfer members to a pre-determined centre parallel to the rods, or, correspondingly, from the centre into the rod magazine, using a feed member provided with a screw surface for moving the rods in the rod magazine, preventing the displacement of the rods from contact with the screw surface, supporting the rods with the screw surface, and rotating the feed member about its rotation axis, the rods thus moving in the rod magazine towards a feed station located at an outermost end thereof or away from the feed station, depending on the direction of rotation, due to the influence of the screw surface, wherein the feed member in the rod magazine is tilted in relation to the rods to be handled on a plane parallel to the longitudinal axes of the rods.

2. The method according to claim 1, comprising the step of using the feed member in which the screw surface is formed of a spiral for moving the rods in the rod magazine.

3. The method according to claim 1, comprising the step of using the feed member includes using an elongated screw provided with a screw surface for moving the rods in the rod magazine.

4. The method according to claim 1, wherein the feed member is tilted to a predetermined angle in relation to the rods, the degree of the angle depending on the pitch of the screw surface, and the method comprises the step of:

supporting the surface of the rods in the rod magazine against a linear contact surface of the screw surface.

5. The method according to claim 1, wherein tilting the feed member in relation to the rods reduces gaps between the rods and the screw surface.

6. The method according to claim 1, comprising the step of feeding at the feed station the outermost rod in the rod magazine with the feed member against at least one counter surface.

7. The method according claim 1, comprising the steps of using a transfer member for moving rods from the feed station to the centre and vice versa, the transfer member comprising an arm that is turned with a turning device between the feed station and the centre, turning the transfer member to its initial position at the upper part of the feed member and feeding the outermost rod that is in the rod magazine with the feed member against a counter surface at the outermost end of the arm, fastening the outermost rod to gripping means provided in the arm, and turning the arm from the initial position on a curvilinear path so that the rod supported by the gripping means sets to the centre.

8. The method according to claim 1 comprising the step of using a transfer member for moving rods from the feed station to the centre and vice versa, the transfer member being moved linearly between the feed station and the centre.

9. The method according to claim 1, comprising the step of moving the feed station of the rod magazine into the centre when the rods are being moved between the centre and the rod magazine.

10. The method according to claim 1, comprising the steps of moving the feed station of the rod magazine into the centre when the rods are being moved between the centre and the rod magazine, and turning the rod magazine in relation to a joint, whereby the feed station moves on a curvilinear path from the initial position to the centre and vice versa.

11. The method according to claim 1, comprising the steps of moving the feed station of the rod magazine into the centre when the rods are being moved between the centre and the rod magazine, and turning the rod magazine with a joint mechanism, whereby the feed station moves along a curvilinear path from the initial position to the centre and vice versa.

12. The method according to claim 1, comprising the steps of moving the feed station of the rod magazine into the centre when the rods are being moved between the centre and the rod magazine, and turning the rod magazine under the guidance of a guide surface so that the feed station moves from the initial position to the centre and vice versa.

13. The method according to claim 1, comprising the steps of moving the feed station of the rod magazine into the centre when the rods are being moved between the centre and the rod magazine, and turning the rod magazine by at least one linear movement so that the feed station moves from the initial position to the centre and vice versa.

14. The method according to claim 1, comprising the steps of moving the feed station of the rod magazine into the centre when the rods are being moved between the centre and the rod magazine, and keeping the rod coupled to the feed station with the feed member and at least one counter piece for at least the duration of the transfer movement between the feed station and the centre.

15. A method for handling rods in a rock drilling rig, the method comprising the steps of:

storing elongated rods into a linear rod magazine, in which the rods are supported parallel to each other, side by side, and at a distance from one another, moving the rods with a feed member in the rod magazine, and moving a rod that is in the rod magazine by means of transfer members to a pre-determined centre parallel to the rods, or, correspondingly, from the centre into the rod magazine, using a feed member provided with a screw surface for moving the rods in the rod magazine, preventing the displacement of the rods from contact with the screw surface, supporting the rods with the screw surface, and rotating the feed member about its rotation axis, the rods thus moving in the rod magazine towards a feed station located at an outermost end thereof or away from the feed station, depending on the direction of rotation, due to the influence of the screw surface, wherein moving the rods in the rod magazine is by means of at least two spaced-apart feed members, and by tilting the feed members into opposite directions from one another.

16. A linear rod magazine for a rock drilling rig, comprising:

at least one feed member arranged to support a plural number of rods parallel to each other, side by side, and to move them in the rod magazine, and transfer means for moving a rod that is at the feed station of the rod magazine to a predetermined centre that is parallel with the rods and, correspondingly, from the centre to the feed station, wherein the feed member comprises a screw surface that supports the rods in the rod magazine, the rods are supported by at least one transverse support on the side facing away from the feed member, which prevents the displacement of the rods from contact with the screw surface, and the feed member is rotatable about its rotation axis, whereby the rods move in the rod magazine towards the feed station or away from it, depending on the direction of rotation, due to the influence of the screw surface, and wherein the feed member in the rod magazine is tilted in relation to the rods to be handled on a plane parallel to the longitudinal axes of the rods.

17. The rod magazine according to claim 16 wherein the screw surface of the feed member is a spiral.

18. The rod magazine according to claim 16 wherein the feed member is a screw having a screw surface on its outer surface.

19. The rod magazine according to claim 16 wherein the feed member is tilted in relation to the rods by an angle proportional to the pitch of the screw surface whereby a linear contact surface is provided between the lower surface of the rods in the rod magazine and the screw surface.

20. The rod magazine according to claim 16 wherein the feed member is tilted in relation to the rods and in proportion to the diameter of the rods to be stored, the rod magazine being adjustable for rods of different diameters.

21. The rod magazine according to claim 16 wherein the transfer members comprise at least one arm, which is turnable by means of a turning device along a curvilinear path between the feed station at the upper part of the feed member and the centre, and the outermost end of the arm is provided with gripping means for gripping the rods.

22. The rod magazine according to claim 16 wherein the transfer means comprise at least one arm, which in turn comprises gripping means for gripping the rods and which is arranged to move linearly between the feed station and the centre.

23. The rod magazine according to claim 16 wherein the rod magazine is movably arranged in relation to the centre, the feed station being thus movable between the initial position and the centre.

24. The rod magazine according to claim 16, wherein the rod magazine is movably arranged in relation to the centre, the feed station being thus movable between the initial position and the centre, and the rod magazine is arranged to turn in relation to a joint, the feed station thus being turnable between the initial position and the centre.

25. The rod magazine according to claim 16, wherein the rod magazine is movably arranged in relation to the centre, the feed station being thus movable between the initial position and the centre, and the rod magazine is turnably arranged by means of a joint mechanism, the feed station being thus turnable between the initial position and the centre.

26. The rod magazine according to claim 16, wherein the rod magazine is movably arranged in relation to the centre, the feed station being thus movable between the initial position and the centre, and the rod magazine is arranged to move linearly to take the feed station to the centre.

27. The rod magazine according to claim 16, wherein the rod magazine is arranged to a feed beam that is at the outermost end of a boom.

28. A rock drilling unit comprising:

a feed beam, a rock drilling machine to which a tool comprising a plural number of detachably interconnected drill rods may be coupled, a feeding device for moving the rock drilling machine on the feed beam, and a linear rod magazine for storing and handling drill rods, the rod magazine comprising at least one feed member for keeping a plural number of drill rods parallel to each other, side by side, and for moving them in the rod magazine, and, further, transfer means for transferring a drill rod located at the feed station of the rod magazine to the centre of the drill line and, correspondingly, from the centre to the feed station, wherein the feed member of the rod magazine comprises a screw surface by which the drill rods are arranged to be transferred, and the feed member is rotatable about its rotation axis, whereby the rods are arranged to move in the rod magazine towards the feed station or away from it, depending on the direction of rotation, due to the influence of the screw surface, and wherein the feed member in the rod magazine is tilted in relation to the rods to be handled on a plane parallel to the longitudinal axes of the rods.

29. A bolting unit comprising:

a feed beam;

a bolting device that allows a rock bolt to be arranged into a drill hole drilled in advance, and a linear rod magazine for storing and handling rock bolts, the rod magazine comprising at least one feed member for holding a plural number of rock bolts parallel to each other, side by side, and for moving them in the rod magazine, and, further, transfer means for transferring a rock bolt located at the feed station of the rod magazine to the centre of the bolting line and, correspondingly, from the centre to the feed station, wherein the feed member of the rod magazine comprises a screw surface by which the rock bolts are arranged to be transferred, and the feed member is rotatable about its rotation axis, whereby the rock bolts are arranged to move in the rod magazine towards the feed station or away from it, depending on the direction of rotation, due to the influence of the screw surface, and wherein the feed member in the rod magazine is tilted in relation to the rods to be handled on a plane parallel to the longitudinal axes of the rods.

* * * * *